US005763845A

United States Patent [19]

Hsieh

[11] Patent Number: 5,763,845

[45] Date of Patent: Jun. 9, 1998

[54] LUMINOUS CIRCUIT HOUSING WITH ROTARY SWITCH

[76] Inventor: Frank Hsieh, 9th-1 Floor, Kuang Fu South Road, Taipei, Taiwan

[21] Appl. No.: 675,710

[22] Filed: Jul. 2, 1996

[51] Int. Cl.[6] ..... F21V 23/04

[52] U.S. Cl. ..... 200/60; 362/205

[58] Field of Search ..... 200/60, 316; 362/185–206, 362/157, 801–806

[56] References Cited

U.S. PATENT DOCUMENTS 5,091,611 2/1992 Reeves et al. ..... 200/60

5,272,606 12/1993 Blaney ..... 362/205 X

*Primary Examiner*—J. R. Scott

*Attorney, Agent, or Firm*—Browdy and Neimark

[57] ABSTRACT

A luminous device comprises a base mount, a circuit housing, a guide disk, a light bulb, a battery set, and a rotary switch. The base mount is provided therein with a receiving compartment in which the circuit housing is located. The circuit housing is provided with a cavity having a female threaded portion, a battery compartment, a light bulb compartment, a upper contact surface located between the threaded portion and the battery compartment, and a lower contact surface located between the battery compartment and the light bulb compartment. The guide disk has a first guide hole and a second guide hole. The light bulb has a short leg extending through the first guide hole, and a long leg passing through the second guide hole to emerge on the upper contact surface. The battery set is located over the guide disk. The rotary switch is mounted in the cavity of the circuit housing such that a male threaded portion of the rotary switch is engaged with the female threaded portion of the circuit housing, and that the rotary switch is located at a high level so as to keep a conducting piece of the rotary switch apart from the long leg of the light bulb at such time when the rotary switch is turned off, and further that the rotary switch is located at a low level so as to cause the conducting piece of the rotary switch to make contact with the long leg of the light bulb at such time when the rotary switch is turned on.

2 Claims, 3 Drawing Sheets

LUMINOUS CIRCUIT HOUSING WITH ROTARY SWITCH

FIELD OF THE INVENTION

The present invention relates generally to a luminous device, and more particularly to a luminous circuit housing with rotary switch.

SUMMARY OF THE INVENTION

The conventional luminous devices are generally provided with a slidable switch or push button for turning the power supply on and off. The slidable switch is relatively complicated in construction and is therefore not cost-effective.

SUMMARY OF THE INVENTION

It is therefore the primary objective of the present invention to provide a luminous circuit housing with rotary switch which is simple in construction and can be precasted economically.

In keeping with the principle of the present invention, the foregoing objective of the present invention is attained by a luminous device, which comprises a base mount, a circuit housing, a light bulb, a guide disk, a battery set, and a rotary switch. The circuit housing is provided with a cavity having a threaded portion, a battery compartment, a light bulb compartment, a upper contact surface located between the threaded portion and the battery compartment, and a lower contact surface located between the battery compartment and the light bulb compartment. The guide disk is made of an insulating material and is located on the lower contact surface of the circuit housing. The guide disk has a first guide hole and a second guide hole. The light bulb is located in the light bulb compartment such that the end of a short leg of the light bulb is located on the upper surface of the guide disk via the first guide hole, and that the end of a long leg of the light bulb is located on the upper compartment surface through the second guide hole. The battery set is located over the guide disk such that the short leg of the light bulb is pressed against by the battery set. The rotary switch is engaged with the threaded portion of the circuit housing such that a conducting piece of the rotary switch is capable of making contact with the long leg of the light bulb when the rotary body is rotated.

The foregoing objective, features and functions of the present invention will be more readily understood upon a thoughtful deliberation of the following detailed description of the present invention in conjunction with the accompanying drawings.

DETAILED DESCRIPTION OF THE INVENTION

Figure 1:
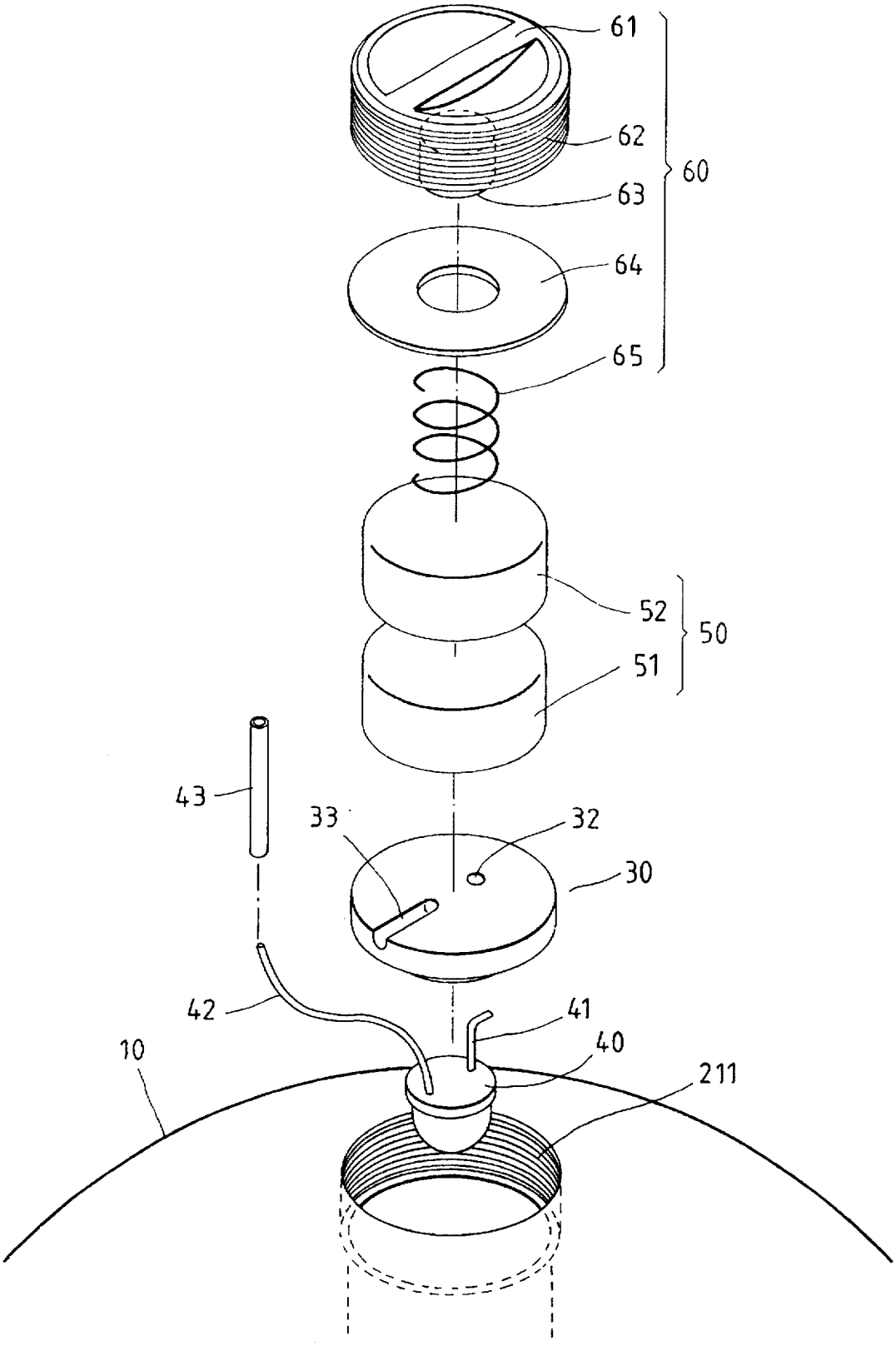
FIG. 1 shows an exploded view of the present invention.
Figure 2:
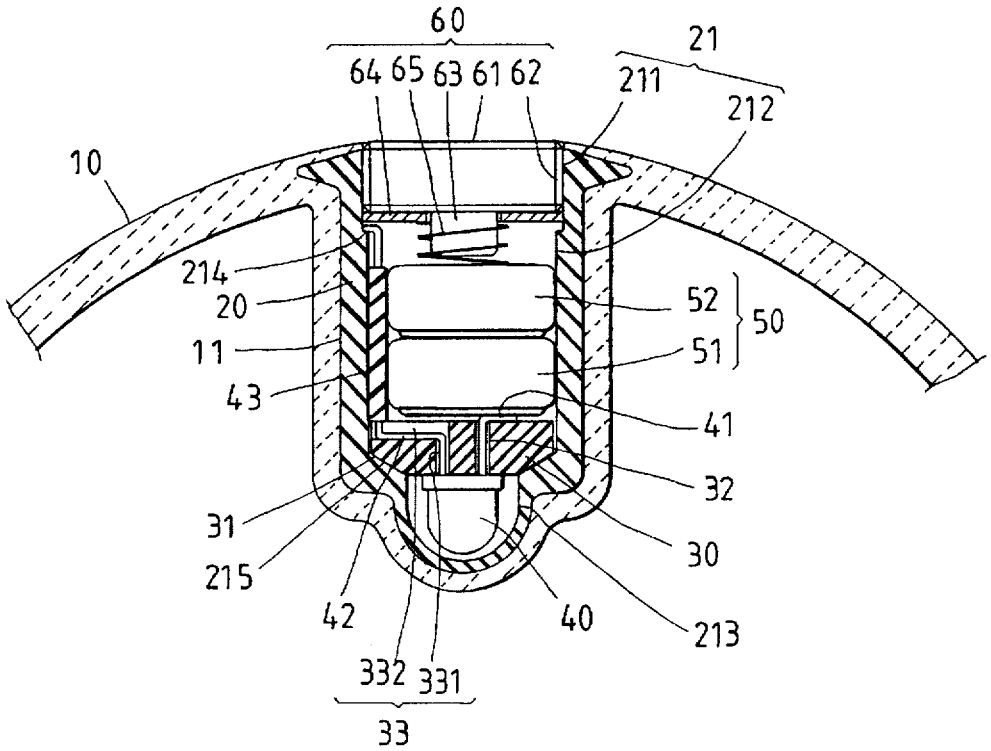
FIG. 2 is a sectional view of the present invention in combination to illustrate the "OFF" state of the present invention.

As shown in FIGS. 1 and 2, a luminous device embodied in the present invention is composed of the component parts, which are described explicitly hereinafter.

A base mount 10 of a transparent or translucent material is hollow in construction and is provided therein with a receiving compartment 11.

A circuit housing 20 is installed in the receiving compartment 11 of the base mount 10 by precast. The circuit housing 20 is provided at the center thereof with a cavity 21 of a stepped construction. The cavity 21 becomes gradually smaller in dimension from the outer end thereof toward the inner end thereof such that the cavity 21 is composed of a female threaded portion 211, a battery compartment 212 and a light bulb compartment 213. In addition, the threaded portion 211 and the battery compartment 212 are provided therebetween with a upper contact surface 214 while the battery compartment 212 and the light bulb compartment 213 are provided therebetween with a lower contact surface 215. The lower contact surface 215 has a tapered portion in contact with the light bulb compartment 213.

A guide disk 30 of an insulating material is conical in shape and is provided with a tapered bottom 31, which is secured to the lower contact surface 215. The guide disk 30 is provided with a first guide hole 32 and a second guide hole 33 which is composed of a straight hole 331, and a cross recessed channel 332 extending to reach the edge of the guide disk 30.

A light bulb 40 such as an LED (light emitting diode) is composed of a short leg 41 and a long leg 42 and is located in the light bulb compartment 213 such that a curved end of the short leg 41 is secured to the guide disk 30 via the first guide hole 32, and that the long leg 42 is put through the straight hole 331. The long leg 42 has a portion that is protruded from the second guide hole 33 and is covered with an insulation jacket 43. The portion of the long leg 42 has one end which emerges from the insulation jacket 43 and is curved. The curved end of the long leg 42 is secured to the upper contact surface 214. As a result, the light bulb 40 is securely held in the light bulb compartment 213.

A battery set 50 is composed of two batteries 51 and 52. The battery 51 is located over the guide disk 30 such that the battery 51 is in contact with the short leg 41 of the light bulb 40.

A rotary switch 60 of a disklike construction is provided on the upper surface thereof with an accessible rib 61. The rotary switch 60 can be turned by pushing the accessible rib 61 with fingers. The body of the rotary switch 60 has a male threaded periphery 62 which is engaged with the female threaded portion 211 of the circuit housing 20. The rotary switch 60 is further provided at the center of the underside thereof with a fitting seat 63 having a diameter smaller than the diameter of the rotary switch 60. A conducting piece 64 is fitted over the fitting seat 63 which is in turn fitted into an elastic conducting body 65. The fitting seat 63 is located between the conducting piece 64 and the battery 52. The elastic conducting body 65 is a metal spring capable of conducting electricity. The battery 52 is urged by one end of the elastic conducting body 65 so as to enable the battery 51 to press against the short leg 41 of the light bulb 40 or to keep the conducting piece 64 apart from the long leg 42 of the light bulb 40 under the normal condition.

As shown in FIG. 2, when the rotary switch of the present invention is OFF, the rotary switch 60 has been rotated to at a high level so that the conducting piece 64 is not in contact with the long leg 42 of the light bulb 40. As a result, the electricity is not made available to the light bulb 40.

Figure 3:
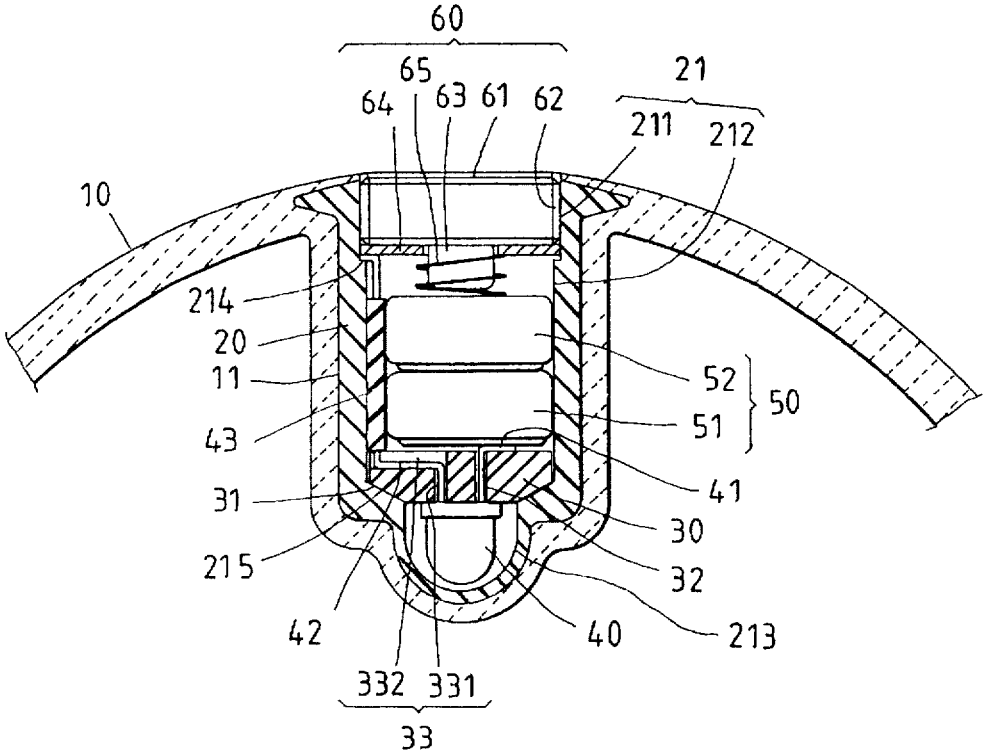
FIG. 3 is a sectional view of the present invention in combination to illustrate the "ON" state of the present invention.
Figure 4:
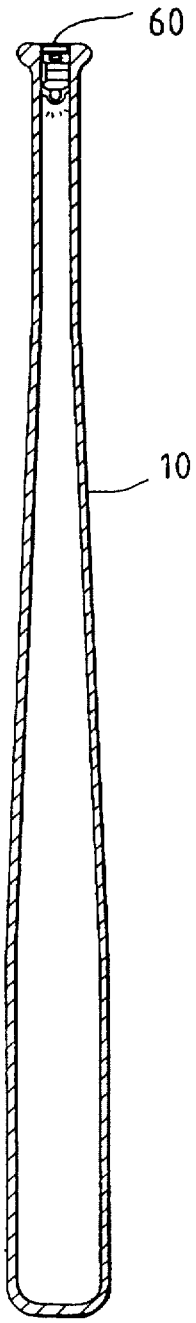
FIG. 4 shows a schematic view illustrating that the present invention is mounted in a base ball bat.
Figure 5:
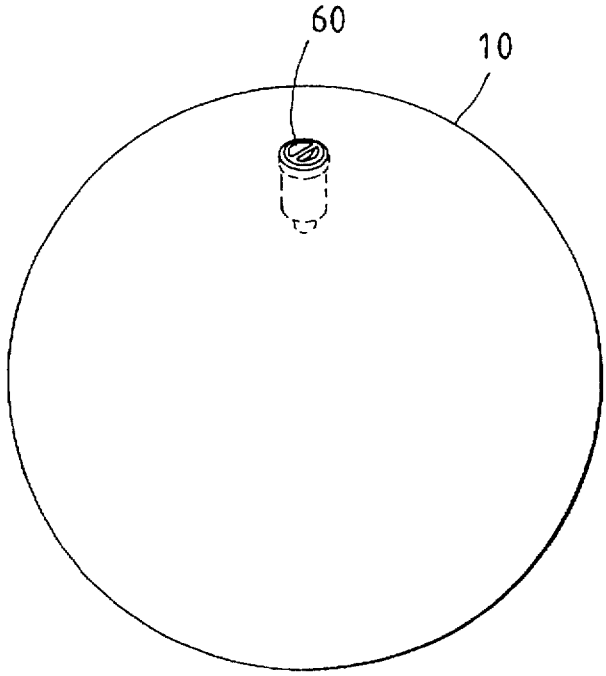
FIG. 5 shows a schematic view illustrating that the present invention is mounted on a spherical body.

As illustrated in FIG. 3, the rotary switch 60 is rotated to move to the low level so as to cause the conducting piece 64 to make contact with the long leg 42 of the light bulb 40. As a result, the electricity is made available to the light bulb 40.

The rotary switch of the present invention is relatively simple in construction and is therefore cost-effective. In addition, the repair work of the rotary switch of the present invention can be easily done by the consumers at large.

The embodiment of the present invention described above is to be regarded in all respects as merely illustrative and not restrictive. Accordingly, the present invention may be embodied in other specific forms without deviating from the spirit thereof. The present invention is therefore to be limited only by the scopes of the following appended claims.

What is claimed is:

1. A luminous circuit housing with a rotary switch comprising:

a base mount of a transparent or translucent material and provided therein with a receiving compartment;

a circuit housing disposed in said receiving compartment of said base mount by precast and provided with a cavity having a female threaded portion, a battery compartment, a light bulb compartment, an upper contact surface located between said threaded portion and said battery compartment, and a lower contact surface located between said battery compartment and said light bulb compartment;

a guide disk of an insulating material and conical in shape, said guide disk being secured to said lower contact surface of said circuit housing, said guide disk further provided with a first guide hole and a second guide hole, said second guide hole being composed of a straight hole and a cross recessed channel extending to reach an edge of said guide disk;

a light bulb such as an LED having a short leg and a long leg, said light bulb located in said light bulb compartment such that a curved end of said short leg is secured to said guide disk through said first guide hole, and that said long leg extends through said straight hole and said cross recessed channel, said long leg having a curved end secured to said upper contact surface;

a battery set located over said guide disk such that said battery set is in contact with said short leg of said light bulb; and a rotary switch of a disklike construction located in said cavity of said housing for turning the power supply on or off;

wherein said rotary switch is provided on an upper surface thereof with an accessible rib for rotating said rotary switch with fingers, said rotary switch having a body provided with a male threaded portion which is engaged with said female threaded portion of said circuit housing, said rotary switch further provided at the center of an underside thereof with a fitting seat which extends through a conducting piece and an elastic conducting body, one end of said elastic conducting body urging a first battery of two batteries of said battery set against a second battery of said two batteries so that said second battery presses against said short leg of said light bulb and to keep said conducting piece apart from said long leg of said light bulb;

wherein said rotary switch is rotatable in a first direction in said circuit housing to keep said conducting piece apart from said long leg of said light bulb when said rotary switch is turned OFF; and wherein said rotary switch is rotatable in a second direction in said circuit housing to cause said conducting piece to make contact with said long leg of said light bulb when said rotary switch is turned ON.

2. The luminous circuit housing with rotary switch as defined in claim 1, wherein said elastic conducting body is a metal coil spring.

* * * * *